United States Patent [19]

Gerry

[11] 4,140,946

[45] Feb. 20, 1979

[54] TRANSIENT MODULATION IGNITION SYSTEM

[76] Inventor: Martin E. Gerry, 13452 Winthrope St., Santa Ana, Calif. 92705

[21] Appl. No.: 812,985

[22] Filed: Jul. 5, 1977

[51] Int. Cl.[2] ..... H05B 37/02; H05B 39/04; H05B 41/36

[52] U.S. Cl. ..... 315/209 R; 123/148 E; 315/166; 315/170; 315/176; 315/153

[58] Field of Search ..... 315/209 R, 209 T, 209 M, 315/213, 172, 214, 176, 215, 216, 170, 171, 209 CD, 166, 167, 153; 307/164; 123/148 E, 148 DC; 361/253, 263

[56] References Cited

U.S. PATENT DOCUMENTS

| | | | |
|---|---|---|---|
| 2,380,707 | 7/1945 | Sawyer | 315/172 X |
| 2,895,080 | 7/1959 | Branker | 315/226 X |
| 3,154,721 | 10/1964 | Sommeria | 315/172 |
| 3,156,826 | 11/1964 | Mutschler | 315/172 X |
| 3,906,919 | 9/1975 | Asik et al. | 123/148 E |
| 3,972,315 | 8/1976 | Munden et al. | 123/148 E |
| 4,033,316 | 7/1977 | Birchenough | 315/176 |

*Primary Examiner*—Saxfield Chatmon, Jr.

[57] ABSTRACT

An ignition system makes use of the Kettering transient voltage induced into the primary winding of an ignition transformer and utilizes a circuit which provides several voltage transients which are intermodulated to provide extremely high energy levels and a plurality of firing pulses during any one igniter firing period. An ignition transformer with multiple primary windings is utilized, the output or secondary winding feeding a conventional distributor.

9 Claims, 6 Drawing Figures

TRANSIENT MODULATION IGNITION SYSTEM

BACKGROUND OF THE INVENTION

This invention is in the field of ignition systems and particularly wherein induced transient voltages of typical Kettering circuits are intermodulated to increase energy levels and also to provide multiple high energy level waveforms.

Typical Kettering circuits provide an induced voltage in the ignition transformer primary that is low in energy level and hence is inadequate to combust all the fuel in an engine.

Such typical prior art circuits, whether or not they are electronically controlled, do not make use of modulation principles to increase the voltage induced.

Also such typical prior art circuits are incapable of providing multiple pulses within a given igniter firing period, and especially none that have made use of intermodulation of such pulses to provide high energy levels.

SUMMARY OF THE INVENTION

Accordingly it is an objective of this invention to utilize passive circuit elements in such a way so as to produce high energy levels of induced voltages into the ignition transformer.

It is another objective of this invention to intermodulate a plurality of Kettering type transient voltages so that the effective induced voltage waveforms into the ignition transformer are extremely high and thereby act to more thoroughly ignite the fuel within an engine.

It is still another objective to provide multiple intermodulated high voltage level waveforms spaced at predetermined distances from each other so that during any one firing cycle the igniter is triggered a number of times for effecting complete fuel combustion.

Hence, an ignition system having electrical igniters and providing a plural number of transient waveforms during firing periods of any one of the igniters, is provided. Such system has first means for initiating each of said transient waveforms in a predetermined order, and second means, electrically connected to the first means, for intermodulating at least two of said transient waveforms.

The first means includes means for providing predetermined spacing between said transient waveforms. The first means also includes means for providing predetermined spacing between the intermodulated transient waveforms. Said first means includes means for providing DC power to the second means during operative mode of the system. Such first means also includes means for timing the transient waveforms.

The system is provided with an ignition transformer having a plural number of primary windings, a plural number of capacitors each of which is electrically connected to one of the primary windings forming a junction therewith, and a switching subsystem having a plural number of switches each of which is electrically connected to said junction. Such subsystem includes a timing wheel coupled to said switches. A DC power source is electrically connected to the primary windings for charging same.

The ignition method produces a plural number of transient waveforms during firing period of any one of a plurality of electrical igniters. Such system energizes a plural number of primary windings of an ignition transformer, activates a plural number of switches connected to the primary windings in a predetermined order for predetermined periods, and induces transient voltages into each of the primary windings. The system then intermodulates a plural number of the induced transient voltages thereby producing increased energy level waveforms. The system spaces such plural number of induced transient voltages concurrently with the intermodulation action. The system also spaces the increased energy level waveforms at predetermined distances therebetween substantially concurrently with the intermodulation action.

DETAILED DESCRIPTION

Figure 1:
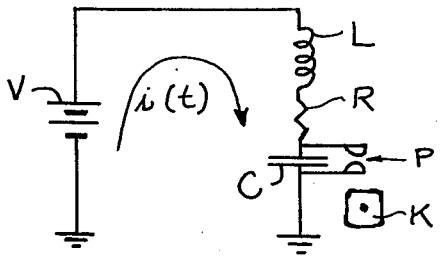
FIG. 1 is an electrical equivalent circuit of part of a Kettering ignition system used for computing the transient voltage waveform induced in the ignition transformer primary just prior to firing of an igniter.

Referring to FIG. 1, the equivalent circuit to determine initial conditions in a typical ignition transformer primary winding, the transient current flow therethrough and the induced voltage into said primary may be calculated, just prior to igniter firing, by the use of Laplace transform mathematics. The circuit herein is a typical Kettering circuit, the ignition transformer secondary not being shown since such is not needed for these calculations.

These calculations will lay the basis for a superior ignition system, as will be seen hereinbelow. The parameters used are typical to the Kettering system, wherein:

$V = 12$ volts, DC battery voltage $L = 6.7 \times 10^{-3}$ henries, the primary winding self inductance $R = 1.4$ ohms, the series equivalent resistance of the primary winding $C = 0.5$ microfarads, the capacitor in series with the primary winding From FIG. 1, the equation for the voltage drops in the system may be written directly in Laplace transform notation to determine first the initial charges in the inductance and capacitor. Since during charging time of the inductance, the capacitor is short circuited by points P, which points are driven by cam K, there will only be an initial charge in the inductance developed during the charging period of the system, and none in capacitor C.

Exemplary calculations for the worst case condition is encountered in an eight cylinder engine driven at 6000 revolutions per minute, wherein:

$$\text{The charge period} = 30^\circ/360^\circ \times 2 \times 10^{-2}\ \text{sec.} = 1.67 \times 10^{-3}\ \text{sec.} \quad (1)$$

$$\text{The discharge or firing period} = 15^\circ/360^\circ \times 2 \times 10^{-2}\ \text{sec.} = 0.83 \times 10^{-3}\ \text{sec.}$$

The initial current condition will be:

$$i_o \Big|_{t=1.67 \times 10^{-3}} = \frac{V}{R}[1 - e^{-(R/L)t}] = 2.53 \text{ amperes} \quad (2)$$

The initial voltage condition for inductance L will be:

$$Li_o = 6.7 \times 10^{-3} \times 2.53 = 0.017 \text{ volts} \quad (3)$$

Keeping in mind that incident to firing, points P open, and taking the initial voltage of $Li_o$ into account, the voltage equation in Laplace transform format is:

$$V/s = -Li_o + (Ls + R + 1/Cs)\, I(s) \quad (4)$$

from which:

$$I(s) = \frac{V + Li_o s}{L\left(s^2 + \frac{R}{L}s + \frac{1}{LC}\right)} = \frac{1791 + 2.53s}{(s + 104 \pm j\,1.73 \times 10^4)} \quad (5)$$

The Laplace transform of the current I(s) may be converted into the time domain by taking the inverse Lapalce transform, which in this case may be accomplished by solving for the residues at the poles. Hence, $$\frac{(1791 + 2.53s)}{(s + 104 \pm j\,1.73 \times 10^4)} e^{st} = \frac{A}{s + 104 - j\,1.73 \times 10^4} + \frac{B}{s + 104 + j\,1.73 \times 10^4} \quad (6)$$

from which the residue provide the current i(t) in the time domain:

$$i(t) = -2.53\, e^{-104t} \cos 1.73 \times 10^4 t + 0.1188\, e^{-104t} \sin 1.73 \times 10^4 t \quad (7)$$

The transient voltage induced into the primary winding prior to igniter firing is defined by Faraday's law of induction, where:

$$e(t) = -L\, di/dt \quad (8)$$

Differentiating (7) and multiplying by −L such differentiated solution, results in:

$$e(t) = -294\, e^{-104t} \sin 1.73 \times 10^4 t - 16\, e^{-104t} \cos 1.73 \times 10^4 t \quad (9)$$

Evaluating (9) for the purpose of graphing same, by evaluating the component parts of (9) for various values of time, we obtain table (10):

(10)

| t millisec. | $e^{-104t}$ | sin 1.73× $10^4$t | cos 1.73× $10^4$t | entire sine function | entire cosine function | approx. e(t) |
|---|---|---|---|---|---|---|
| 0 | 1 | 0 | −1 | 0 | −16 | −16 |
| .1 | .989 | +.987 | −.159 | −287 | +2 | −285 |
| 1.000 | .901 | −.999 | +.021 | +265 | −.3 | +265 |
| 1.088 | .893 | −.026 | +.999 | +6.8 | −14.3 | −7 |
| 2.175 | .798 | −.072 | +.997 | +16.9 | −12.7 | +4 |
| 3.264 | .712 | −.081 | +.997 | +17 | −11.4 | +6 |
| 4.352 | .636 | −.108 | +.738 | +20.3 | −7.5 | +13 |

-continued (10)

| t millisec. | $e^{-104t}$ | sin 1.73× $10^4$t | cos 1.73× $10^4$t | entire sine function | entire cosine function | approx. e(t) |
|---|---|---|---|---|---|---|
| 5.919 | .541 | +.959 | −.284 | −152.5 | +2.5 | −150 |
| 6.528 | .507 | −.163 | +.987 | +24 | −8 | +16 |
| 7.616 | .453 | −.186 | +.983 | +25 | −7 | +18 |
| 8.704 | .405 | −.216 | +.977 | +26 | −6 | +20 |
| 9.792 | .361 | −.242 | +.970 | +26 | −6 | +20 |
| 10.000 | .353 | −.211 | −.978 | +22 | +6 | +28 |

The evaluated results of e(t) as shown in table (10) are shown graphically in FIG. 2, from which can be seen that perturbations subsequent to 1 millisecond are trivial and for our purpose may be subsequently neglected.

Figure 2:
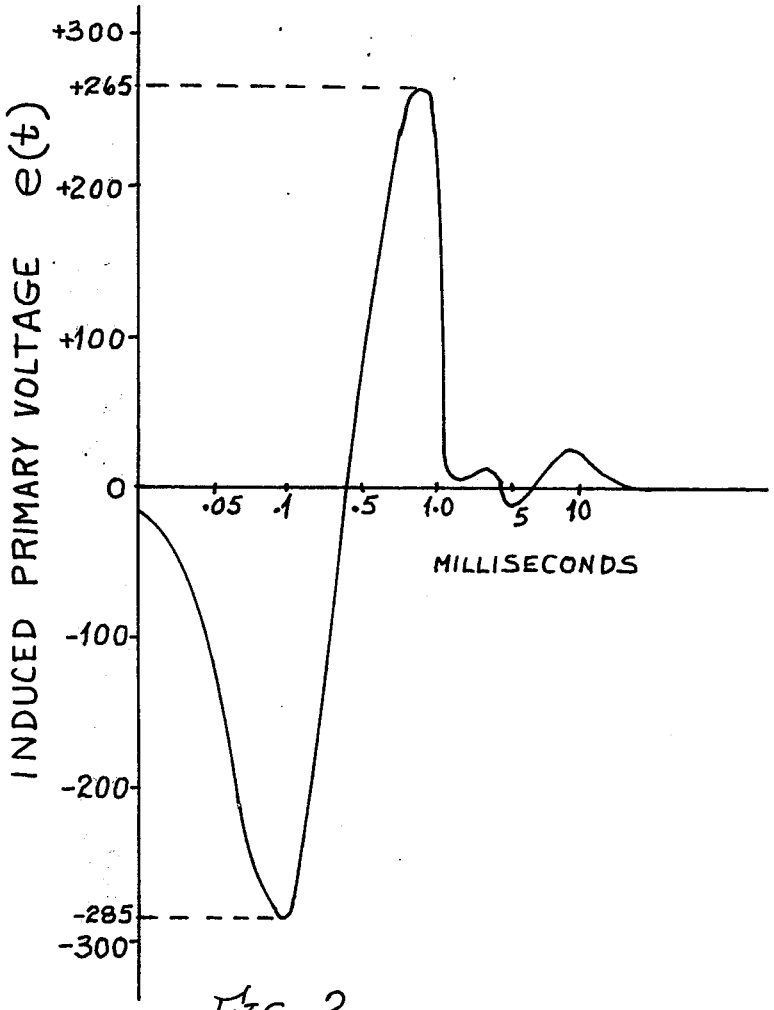
FIG. 2 is a graph of the computed transient volatage waveform induced in the ignition transformer primary.

It can also be seen from FIG. 2 that there are electrical considerations necessitating electrical initiation of the igniters in advance of top dead center position of the pistons, in addition to flame initiation and propagation problems, since it takes that amount of time for the negative part of the induced voltage to build up and swing to a positive maximum.

Neglecting perturbations subsequent to 1 millisecond, a plurality of Kettering circuits identical to that having characteristics of FIG. 2, may be utilized to obtain both an increased effective induced voltage and simultaneously a plural number of firings of each igniter.

Figure 3:
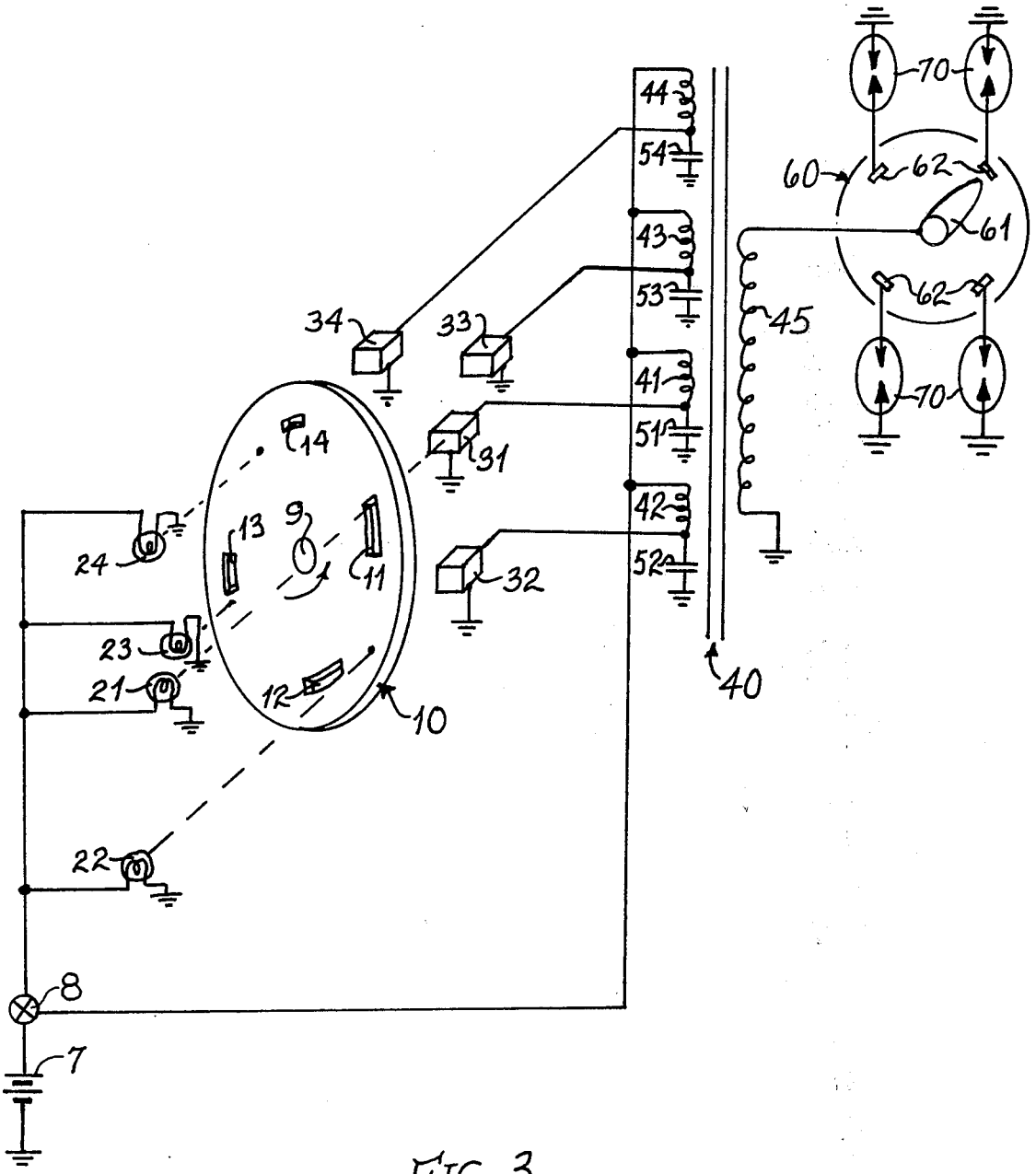
FIG. 3 is an electro-mechanical schematic of the system according to the invention.
Figure 4:
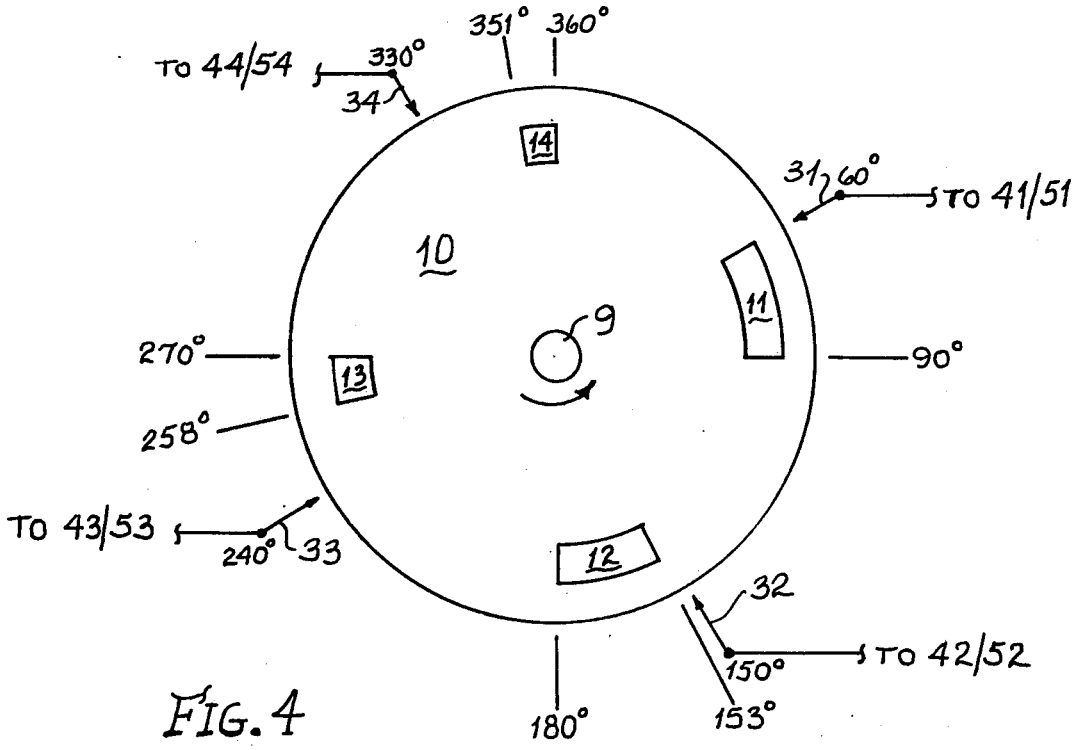
FIG. 4 is a mechanical schematic illustration of a timing wheel used in FIG. 3 system.
Figure 5:
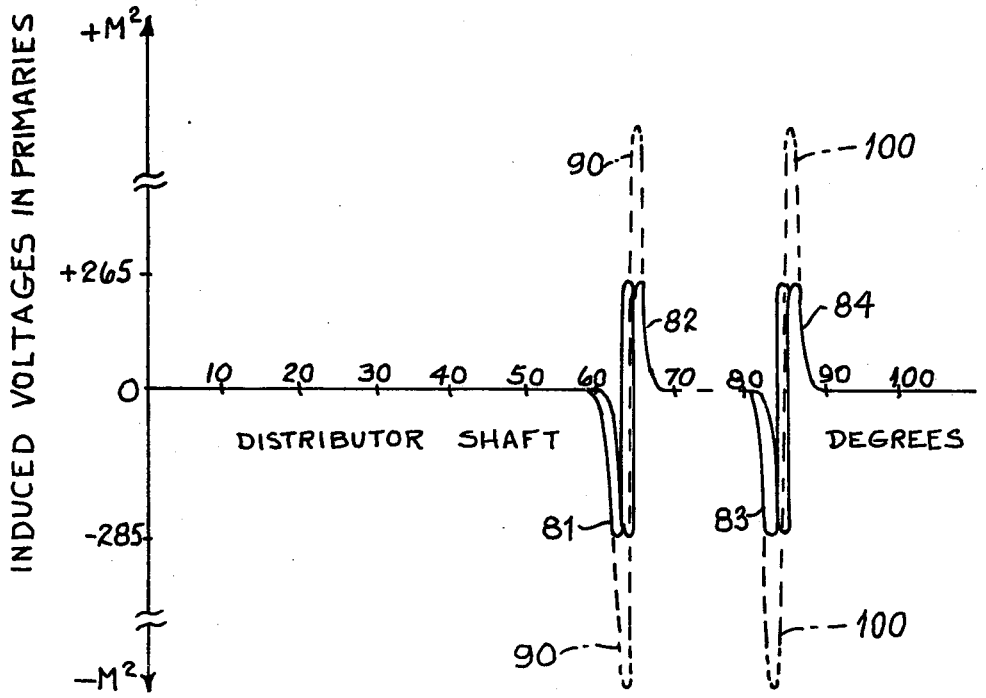
FIG. 5 is a graph of intermodulated waveforms produced in the system of FIGS. 3 and 4.

Referring to FIGS. 3, 4 and 5, the system is shown mechanized in FIG. 3 illustrating an electro-mechanical schematic of such ignition system usable in a four cylinder engine, one igniter per cylinder, being powered by this system.

Battery 7 is used to power the system through ignition switch 8. The conventional ground symbol is used as the electrical return path throughout the specification, and therefore such return path will be understood to exist and need not be discussed.

Lamps or light emitting solid state devices such as 21, 22, 23 and 24 are powered by DC through ignition switch 8. Disk 10, driven by distributor shaft 9 in a counterclockwise direction as viewed in FIGS. 3 and 4, has slits 11, 12, 13 and 14 therein located at the periphery of the disk to permit light emitted by lamps 21, 22, 23 or 24 to be passed through the slits at predetermined intervals so as to activate respectively light sensor switches 31, 32, 33 and 34 in accordance with the angular position of disk 10. The output of switch 31 is connected at the junction of primary winding 41 of transformer 40 and capacitor 51. The outputs of switches 32, 33 and 34 are respectively connected at junctions of primary windings and their respective capacitors 42/52, 43/53 and 44/54. The other sides of the primary windings are connected to ignition switch 8 to provide DC power to the primary windings. Transformer 40 has a secondary high voltage winding 45 which is connected to rotor 61 of distributor 60. Stationary members 62 of distributor 60 each have an igniter 70 connected thereto.

The operation of the system may be more readily understood by examination of disk 10 in its mechanical schematic form shown in FIG. 4 together with the system performance as illustrated in FIG. 5.

Considering the firing of one igniter 70 in a four cylinder engine, the conventional transformer primary is generally charged for a period of 60 degrees and discharged or igniter fired when a light beam passing through slit 11 from lamp 21, for example, causes light sensor switch 31 to remove a short circuit from across capacitor 51 to cause a field collapse in primary winding 41 and a ringing transient of primary 41 and capacitor 51, enabling the transfer of the induced voltage from primary 41 to secondary 45. Light from lamp 21 will therefore be permitted to pass through slit 11 from the 60° position of disk 10 to its 90° position. Only a portion of the distance between 60° and 90° will be needed to create the transient wave 81, which is a compressed view of the wave shown in FIG. 2 without the small perturbations therein. However, it is desired to prevent primary winding 41 from being energized by DC power prior to its dwell period between 90° and 150°, and accordingly slit 11 extends to the beginning of such dwell period to the 90° point.

As disk 10 continues to be driven, an additional 3° subsequent to the initiating of an induced transient voltage in primary 41, primary 42 will begin its transient voltage initiation by virtue of lamp 22 now causing a light beam to pass through slit 12 to activate light switch 32 and permit capacitor 52 and primary 42 to ring according to transient waveform 82.

At this time, light switches 33 and 34 will not be activated since disk 10 will not yet permit light to pass through either slits 13 or 14.

However, noting particularly waveforms 81 and 82 of FIG. 5, it may be seen that they overlap. This means that since each is passed through its respective transformer primary winding 41 and 42, a non-linear device, amplitude intermodulation between these two identical waveform voltages will occur.

As a first order approximation, inspection of expression (9) will show that the sine term is dominant since the modulus thereof is substantially greater than that of the cosine term. Considering the expression for amplitude modulation:

$$e_{mod} = (e_1 + e_2) + 1/2!\,(e_1 + e_2)^2 + 1/3!\,(e_1 + e_2)^3 + \ldots \quad (11)$$

wherein $e_1$ is the induced voltage at 81, and $e_2$ the induced voltage at 82, and both are identical, expression (11) reduces to approximately the second term of the infinite series of (11), neglecting higher order expansions and may be written as:

$$e_{mod} \cong 2\,e^2 \text{ where e is approximated as } -294\,e^{-104t} \sin 1.73 \times 10^4 t \quad (12)$$

The approximation is used since the actual expansion of (11) substituting (9) therein will become inordinately complex, and we can obtain sufficient visibility of the functions performed by such approximation.

The modulus M of expression (12) will therefore be 294, which when squared will become extremely large. Such large modulus is implied by the dotted composite curve 90 of waveforms 81 and 82, and the dotted composite curve 100 of waveforms 83 and 84, and such composite curves will tend to approach the theoretical $M^2$ values in the positive and negative excursions of curves 90 and 100, limited by practical parameters in the real components of the system that are difficult to accurately compute.

Hence it can be seen that further rotation of disk 10 will cause the other pair of waveforms 83 and 84 to be generated respectively in primary 43 and capacitor 53, and in primary 44 and capacitor 54 respectively, to form composite curve 100 in similar manner and character as curve 90.

Waveform 90 will have decayed when waveform 100 is created since a span of 18° elapses after initiation of waveform 81, before waveform 83 begins to be initiated to ring primary 43 and capacitor 53. At that time, light from lamp 23 passes through slit 13 to activate light switch 33 which removes the short circuit from across capacitor 53 to create the transient 83. Similarly, 3° later, light from lamp 24 is permitted to pass through slit 14 to activate light switch 34 and cause same to remove short circuit from across capacitor 54 to generate waveform transient 84. Waveforms 83 and 84 form composite waveform 100 by amplitude intermodulation as discussed above in connection with waveforms 81 and 82. Hence the added 18° spacing subsequent to end of slit 12 will cause composite waveforms 90 and 100 to have a substantial separation therebetween, but since both waveforms 90 and 100 are within the conventional firing period of 60° - 90° of distributor shaft rotation, the first in sequence igniter, as well as subsequent igniters, will receive each a double very high energy pulse to efficiently fire the igniter.

It may be seen by examining disk 10 in FIG. 4, that subsequent to forming waveform 84, no light will be transmitted through any of the slits 11–14 since disk 10 will continue to be rotated during the next 60 degrees through a dwell period to permit primaries 41–44 to be charged, during which time capacitors 51–54 will be short circuited by switches 31–34 because of the absence of light upon such switches. After the 60° dwell period, disk 10 will be positioned so that slit 11 will be in place between the 360° and 330° span to effect ignition of the next in sequence igniter 70 and to repeat the waveforms shown in FIG. 5 for such next in sequence igniter firing. The third and fourth igniters will be fired in similar fashion as above described, after which disk 10 will be again in its initial position with respect to switches 31–34 as shown in FIGS. 3 and 4 and the results thereof functionally displayed in FIG. 5.

Figure 6:
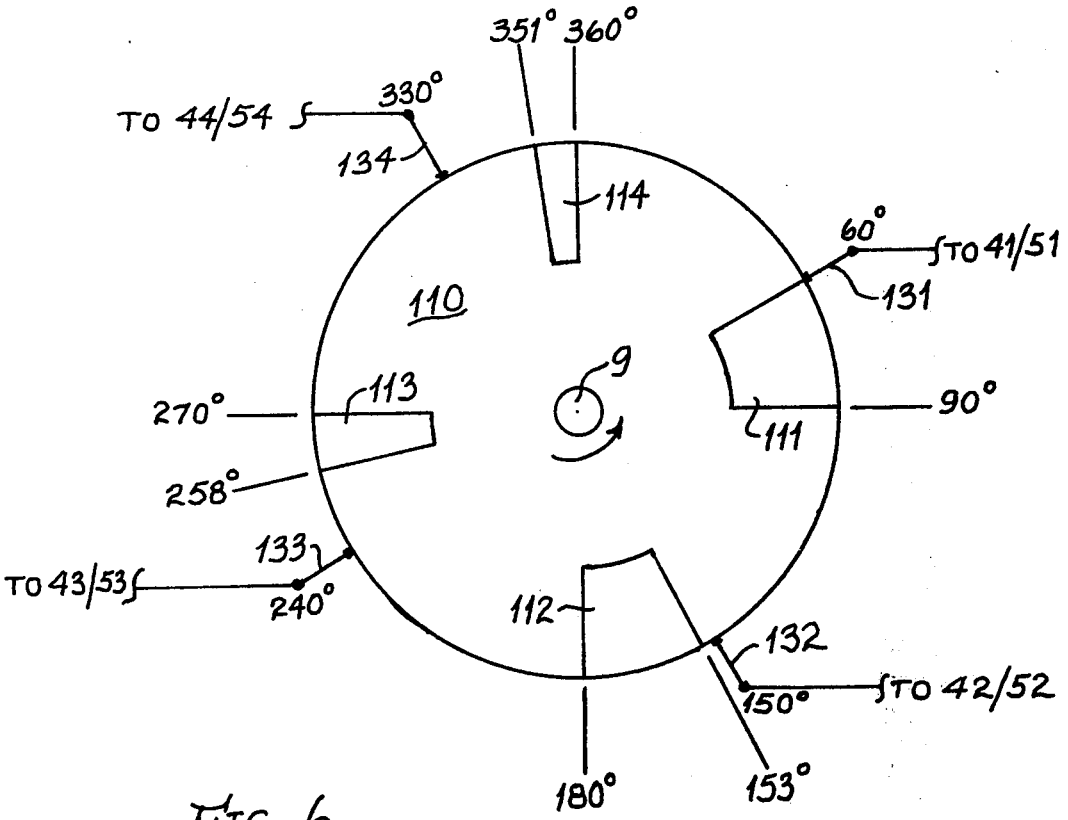
FIG. 6 is a mechanical schematic illustration of another timing wheel that may be used with the system of FIG. 3, alternate to the timing wheel shown in FIG. 4.

Referring to FIG. 6, a metallic disk is shown at 110 driven by distributor shaft 9 in a counterclockwise direction. Disk 110 and associated pick up contactors 131, 132, 133 and 134 positioned respectively at 60°, 150°, 240° and 330° of the disk periphery, performs the same function as disk 10 and its associated light switches per FIGS. 3 and 4, and contactors 131–134 are located in identical positions as the light sensing devices. Disk 110 is at ground potential by virtue of being attached to metallic distributor shaft 9. Disk 110 has electrically insulating segments shown at 111, 112, 113 and 114, so that when contactors 131, 132, 133 and 134 are positioned in cooperation with such segments, electrical paths, connecting the contactors with their respective junctions of primary windings and capacitors, are broken, and the particular capacitor connected to the particular contactor of the broken path has the short-circuit removed therefrom as long as the particular contactor is in cooperation with the periphery of the insulating segment. Thus, the action obtained by this disk and contactors is equivalent to passing the light beam in FIGS. 3–4 through the appropriate slit in the disk to remove the short-circuit from the particular capacitor in circuit with its primary winding, and to permit the transient ringing in that particular primary circuit.

It becomes evident that disk 110 may be used as a magnetic pulse timer when contactors 131–134 are magnetic heads biased by external ciruitry to produce a pulse each time the head loses contact with the magnetic material of disk 110 by virtue of disk 110 being driven so that the heads make contact with segments 111–114 to break the flux path in that head and activate thereby an electronic switch connected to each head so as to remove the shortcircuit from across the capacitor in circuit with the particular primary winding in question.

It is also obvious that disks such as in FIGS. 3, 4 and 6 may be readily adapted to operate 6 and 8 cylinder engine ignition systems. In the 8 cylinder system, the arc length of the slits in FIGS. 3–4 or the outer disk peripheries of the insulated segments in FIG. 6, may be divided in half, so that 8 slits or 8 segments will be available, and either 8 primaries may be used or 4 primaries may still be used when 180° disposed light sensors, contactors or heads are connected in parallel; in this instance the pattern of progressively smaller length slits or segments will be repeated. In the 6 cylinder case, the probable most expedient situation would be to scale the slits or segments and their dwell periods in between, to two-thirds the dwell and slit lengths compared to the 4 cylinder case, and 6 appropriate sensores used, each located at the end of a particular dwell period. In such case, 6 primary windings would be expedient with appropriate capacitors connected to each, similar to the 4 cylinder method of connection. What is claimed is:

1. An ignition system having electrical igniters, comprising the combination of:

a transformer having a plural number of primary windings and a secondary winding, a separate capacitor in circuit with each of the primary windings, each said separate capacitor and primary winding being a primary circuit;

a power source electrically connected only to said primary windings; and means, coupled to the primary circuits, for providing a plural number of transient waveforms during any single firing period of any one of said igniters by precharging by said source each of said primary windings and inhibiting the charging of any of said capacitors in a first mode of operation of the system and by discharging each of said primary windings into its respective capacitor in a second mode of operation of said system in a predetermined sequence.

2. The invention as stated in claim 1, wherein said power source provides DC power to the primary windings during operative mode of the system.

3. An ignition system, comprising the combination:

an ignition transformer having a plural number of primary windings;

a plural number of capacitors each of which is electrically connected to one of the primary windings thus forming a junction therewith; and means, electrically connected to each said junction, for intermittently short circuiting said capacitors in a predetermined sequence, each said primary winding being energized during period when its respective capacitor is being short circuited by said means.

4. The invention as stated in claim 3, wherein said means includes a timing wheel and a plurality of switches, said timing wheel being coupled to said switches.

5. The invention as stated in claim 3, including a DC power source electrically connected to said primary windings during operative mode of the system.

6. The invention as stated in claim 4, wherein said timing wheel has electrically conductive and electrically insulative portions in alternation, said portions being of predetermined size and shape and positioned at predetermined locations of the wheel.

7. An ignition method producing a plural number of transient waveforms during firing period of any one of a plurality of electrical igniters, comprising in combination the steps of:

energizing a plural number of primary windings of an ignition transformer, wherein each of the primary windings has a capacitor in series therewith, while inhibiting the energizing of any said capacitor;

discharging each of the primary windings into its respective capacitor in a predetermined order;

inducing a transient voltage in each of the primary windings; and intermodulating a plural number of the induced transient voltages thereby producing increased energy waveforms.

8. The invention as stated in claim 7, including the step of spacing the induced transient voltages at selected intervals, concurrently with the step of intermodulating.

9. The invention as stated in claim 7, including the step of spacing the increased energy waveforms at predetermined intervals substantially concurrently with the step of intermodulating.

* * * * *